US010046480B2

(12) United States Patent
Karau

(10) Patent No.: US 10,046,480 B2
(45) Date of Patent: Aug. 14, 2018

(54) ROCK FACE SPLITTING APPARATUS AND METHOD

(71) Applicant: PAVESTONE, LLC, Atlanta, GA (US)

(72) Inventor: William H. Karau, Southlake, TX (US)

(73) Assignee: PAVESTONE, LLC, Atlanta, GA (US)

( * ) Notice: Subject to any disclaimer, the term of this patent is extended or adjusted under 35 U.S.C. 154(b) by 133 days.

(21) Appl. No.: 14/546,188

(22) Filed: Nov. 18, 2014

(65) Prior Publication Data

US 2015/0136108 A1 May 21, 2015

Related U.S. Application Data

(60) Provisional application No. 61/905,733, filed on Nov. 18, 2013.

(51) Int. Cl.

| | |
|---|---|
| ***B28D 1/32*** | (2006.01) |
| ***B28D 1/22*** | (2006.01) |
| ***B28D 7/02*** | (2006.01) |

(52) U.S. Cl.

CPC ..... *B28D 1/322* (2013.01); *B28D 1/222* (2013.01); *B28D 7/02* (2013.01)

(58) Field of Classification Search

CPC ..... B28D 1/322; B28D 1/222; B28D 7/02; B28D 1/26; B28D 1/265; B28D 1/28; B28D 1/32; B27L 7/06

See application file for complete search history.

(56) References Cited

U.S. PATENT DOCUMENTS

| | | | |
|---|---|---|---|
| 415,773 | A | 11/1889 | Fiske |
| 470,788 | A | 3/1892 | Devine |
| 511,098 | A | 12/1893 | Shultz |
| 534,462 | A | 2/1895 | Baisley |
| 787,199 | A | 4/1905 | Lloyd |
| 788,379 | A | 4/1905 | Rich |
| 803,014 | A | 10/1905 | McIlravy |
| 806,951 | A | 12/1905 | Bryning |
| 827,879 | A | 8/1906 | Newnham |
| 1,086,975 | A | 2/1914 | Aaronson |

(Continued)

FOREIGN PATENT DOCUMENTS

| | | | |
|---|---|---|---|
| DE | 3702515 A1 * | 8/1988 | ..... B28D 1/003 |
| GB | 924290 | 4/1963 | |

(Continued)

OTHER PUBLICATIONS

Zhou, Yingxin and Jian Zhao. "Advances in Rock Dynamics and Applications." May 25, 2011. CRC Press. p. 430.*

(Continued)

*Primary Examiner* — Christopher M Koehler
*Assistant Examiner* — Joel Crandall
(74) *Attorney, Agent, or Firm* — Jackson Walker LLP; Christopher J. Rourk; Thomas B. Hayes

(57) ABSTRACT

A splitting apparatus comprising a first splitting blade having a smooth top with a width X and a shoulder angle of less than the friction angle, relative to a point in the middle of the top, and a second splitting blade disposed opposite the first splitting blade, the second splitting blade having a smooth top with a width Y and a shoulder angle of less than the friction angle, relative to a point in the middle of the top.

20 Claims, 12 Drawing Sheets

(56) References Cited

U.S. PATENT DOCUMENTS

| | | | | |
|---|---|---|---|---|
| 1,092,621 | A | 4/1914 | Worner | |
| 1,287,055 | A | 12/1918 | Lehman | |
| 1,534,353 | A | 4/1925 | Besser | |
| 1,872,522 | A | 8/1932 | Stuckey | |
| 1,893,430 | A | 1/1933 | McKenzie | |
| 1,919,801 | A * | 7/1933 | Newsom | B28D 1/222 125/23.01 |
| 2,151,468 | A | 10/1936 | Henderson | |
| 2,203,935 | A | 6/1940 | Hedlund | |
| 2,219,606 | A | 10/1940 | Schoick | |
| 2,313,363 | A | 3/1943 | Schmitt | |
| 2,593,606 | A | 4/1952 | Price | |
| 2,657,681 | A * | 11/1953 | Gatzke | B28D 1/222 125/23.01 |
| 2,746,447 | A * | 5/1956 | Petch | B28D 1/222 125/23.01 |
| 2,775,326 | A | 12/1956 | Blum | |
| 2,867,205 | A * | 1/1959 | Vesper | B28D 1/222 125/23.01 |
| 2,925,080 | A | 2/1960 | Smith | |
| 3,095,868 | A | 7/1963 | Mangis | |
| 3,120,842 | A | 2/1964 | Cox et al. | |
| 3,392,719 | A * | 7/1968 | Clanton | B28D 1/222 125/23.01 |
| 3,425,105 | A | 2/1969 | Guide | |
| 3,492,984 | A | 2/1970 | Harper | |
| 3,559,631 | A | 2/1971 | Mangis | |
| 3,940,229 | A | 2/1976 | Hutton | |
| 3,981,953 | A | 9/1976 | Haines | |
| 4,023,767 | A | 5/1977 | Fontana | |
| 4,050,864 | A | 9/1977 | Komaki | |
| 4,098,865 | A | 7/1978 | Repasky | |
| 4,114,773 | A | 9/1978 | Sekiguchi | |
| 4,139,593 | A | 2/1979 | Holz et al. | |
| 4,178,340 | A | 12/1979 | Hyytinen | |
| 4,193,718 | A | 3/1980 | Wahrendorf et al. | |
| 4,250,863 | A | 2/1981 | Gagnon et al. | |
| 4,335,549 | A | 6/1982 | Dean, Jr. | |
| 4,524,551 | A | 6/1985 | Scheiwiller | |
| 4,627,764 | A | 12/1986 | Scheiwiller | |
| 4,770,218 | A | 9/1988 | Duerr | |
| 4,784,821 | A | 11/1988 | Leopold | |
| D299,067 | S | 12/1988 | Forsberg | |
| 4,802,836 | A | 2/1989 | Whissell | |
| 4,848,309 | A | 7/1989 | Alderete | |
| 4,869,660 | A | 9/1989 | Ruckstuhl | |
| 4,973,192 | A | 11/1990 | Hair | |
| D315,026 | S | 2/1991 | Castonguay et al. | |
| 5,017,049 | A | 5/1991 | Sievert | |
| 5,028,172 | A | 7/1991 | Wilson et al. | |
| 5,031,376 | A | 7/1991 | Bender et al. | |
| 5,056,998 | A | 10/1991 | Goossens | |
| 5,066,070 | A | 11/1991 | Clarke | |
| 5,078,940 | A | 1/1992 | Sayles | |
| 5,152,275 | A | 10/1992 | Landhuis | |
| 5,158,132 | A | 10/1992 | Guillernot | |
| 5,217,630 | A | 6/1993 | Sayles | |
| 5,487,526 | A | 1/1996 | Hupp | |
| 5,534,214 | A | 7/1996 | Sakamoto et al. | |
| D377,181 | S | 1/1997 | Hupp | |
| D378,702 | S | 4/1997 | Blomquist et al. | |
| 5,662,094 | A | 9/1997 | Giacomelli | |
| 5,662,386 | A | 9/1997 | Newman et al. | |
| 5,687,515 | A | 11/1997 | Rodrigues et al. | |
| 5,709,602 | A | 1/1998 | Woolford | |
| 5,722,386 | A | 3/1998 | Fladgard et al. | |
| 5,733,470 | A | 3/1998 | Roth et al. | |
| 5,735,643 | A | 4/1998 | Castonguay et al. | |
| 5,762,061 | A | 6/1998 | Bevan | |
| 5,788,423 | A | 8/1998 | Perkins | |
| 5,827,015 | A | 10/1998 | Woolford et al. | |
| D404,146 | S | 1/1999 | Perkins | |
| 5,879,603 | A | 3/1999 | Sievert | |
| 5,884,445 | A | 3/1999 | Woolford | |
| 6,029,943 | A | 2/2000 | Sievert | |
| 6,050,255 | A | 4/2000 | Sievert | |
| 6,082,057 | A | 7/2000 | Sievert | |
| 6,102,026 | A | 8/2000 | Fladgard et al. | |
| 6,113,379 | A | 9/2000 | LaCroix et al. | |
| 6,138,983 | A | 10/2000 | Sievert | |
| 6,142,713 | A | 11/2000 | Woolford et al. | |
| 6,149,352 | A | 11/2000 | MacDonald | |
| 6,178,704 | B1 | 1/2001 | Sievert | |
| D438,640 | S | 3/2001 | Bolles | |
| 6,209,848 | B1 | 4/2001 | Bolles et al. | |
| D442,703 | S | 5/2001 | Fifield | |
| 6,224,815 | B1 | 5/2001 | LaCroix et al. | |
| D448,861 | S | 10/2001 | Daniels et al. | |
| 6,321,740 | B1 | 11/2001 | Scherer et al. | |
| 6,401,707 | B1 | 6/2002 | Fladgard et al. | |
| D464,145 | S | 10/2002 | Scherer | |
| 6,460,534 | B1 | 10/2002 | Vasquez et al. | |
| 6,464,199 | B1 | 10/2002 | Johnson | |
| 6,502,569 | B1 | 1/2003 | Lee | |
| 6,668,816 | B1 | 12/2003 | Pedersen et al. | |
| 6,874,494 | B2 | 4/2005 | Scherer et al. | |
| D505,733 | S | 5/2005 | Castonguay et al. | |
| 6,886,551 | B2 | 5/2005 | Scherer | |
| 6,910,474 | B1 | 6/2005 | Scherer | |
| 6,918,715 | B2 | 7/2005 | Scherer et al. | |
| 7,055,517 | B1 | 6/2006 | Kitahara | |
| 7,107,982 | B1 * | 9/2006 | Lechner | B28D 1/223 125/23.01 |
| 7,146,974 | B2 | 12/2006 | Scherer | |
| 7,425,106 | B2 | 9/2008 | Altmann et al. | |
| 7,967,001 | B2 | 6/2011 | Scherer et al. | |
| 8,006,683 | B2 | 8/2011 | Scherer et al. | |
| 8,251,053 | B2 | 8/2012 | Scherer | |
| 8,327,833 | B2 | 12/2012 | Scherer et al. | |
| 2002/0015620 | A1 | 2/2002 | Woolford et al. | |
| 2002/0092257 | A1 | 7/2002 | Scherer et al. | |
| 2003/0089363 | A1 | 5/2003 | Suto et al. | |
| 2003/0180099 | A1 | 9/2003 | Scherer et al. | |
| 2004/0200468 | A1 * | 10/2004 | Scherer | B28B 17/0027 125/23.01 |

FOREIGN PATENT DOCUMENTS

| | | |
|---|---|---|
| GB | 1509747 | 5/1978 |
| RU | 2011819 | 4/1994 |
| RU | 2198095 | 2/2003 |

OTHER PUBLICATIONS

"Crush." Collins Dictionary. Oct. 19, 2016. <http://www.collinsdictionary.com/dictionary/english/crush>.*

"Split." Collins Dictionary. Oct. 19, 2016. <http://www.collinsdictionary.com/dictionary/english/split>.*

Russian Patent Office; International Search Report and Written Opinion; PCT Application No. PCT/US2014/066071; dated Mar. 26, 2015.

"Haith Robot System for Aggregate Industries," http://www.hub-4.com/news/109/haith-robot-system-for-aggregate-industries, Jul. 31, 2006.

"Reconstructed Stone—Stone Pitchers," http://www.haithindustrial.co.uk/index.php?sec=cont&id=26, Jul. 31, 2006.

"Natural Stone—Block and Slab Splitting," http://www.haithindustrial.co.uk/index.php?sec=cont&id=32, Jul. 31, 2006.

"Splitting, Cutting, Marking & Layout," http://www.pavetech.com/newtools/cutting.shtm, Jul. 31, 2006.

"Stone Splitter," http://www.pavetech.com/newtools/stonesplitter.shtm, Jul. 31, 2006.

"Splitters/Turnovers," http://www.besser.com/equipment/splitters/, Aug. 3, 2006.

"Split-Face Concrete Block," http://www.toolbase.org/Technology-Inventory/walls/split-face-concrete-block, Aug. 3, 2006.

Canadian Patent Office; Office Action; Canadian Application No. 2,912,574; dated Dec. 11, 2015.

The Response to Office Action submitted to Canadian IP Office dated Mar. 10, 2016 for co-pending Canadian patent application No. 2,912,574.

(56) References Cited

OTHER PUBLICATIONS

The Notice of Allowance issued by Canadian IP Office dated May 2, 2016 for co-pending Canadian patent application No. 2,912,574.
The extended European search report dated May 9, 2016 by European Patent Office for the co-pending European patent application No. 14861436.5.
The reply in response to the extended European search report dated May 9, 2016, as filed to the European Patent Office for the co-pending European patent application No. 14861436.5.
The Communication pursuant to Article 94(3) EPC dated Apr. 7, 2017 issued by the European Patent Office for the co-pending European patent application No. 14861436.5.
The Reply in response to the Communication pursuant to Article 94(3) EPC as filed with the European Patent Office dated Aug. 2, 2017 for the co-pending European patent application No. 14861436.5.

* cited by examiner

ROCK FACE SPLITTING APPARATUS AND METHOD

RELATED APPLICATIONS

This application claims priority to U.S. 61/905,733, filed Nov. 18, 2013, which is hereby incorporated by reference for all purposes as if set forth herein in its entirety.

TECHNICAL FIELD

The present disclosure relates to masonry blocks, and more specifically to a masonry block splitting apparatus and method that creates a convex, or "rock-like" split face without the need for projections and the associated cleaning.

BACKGROUND OF THE INVENTION

Block splitting methods and apparatuses typically include splitters with projections to generate split blocks with a roughened look. These projections get fouled easily, and need to be frequently cleaned.

SUMMARY OF THE INVENTION

A splitting apparatus is provided that includes a first splitting blade with a smooth top that forms a blade edge. The smooth top has a width X and a shoulder angle of less than the friction angle from a point in the middle of the top. A second splitting blade is disposed opposite the first splitting blade, and has a smooth top with a width Y and a shoulder angle of less than the friction angle from a point in the middle of the top.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which.

DETAILED DESCRIPTION OF THE INVENTION

Figure 1:
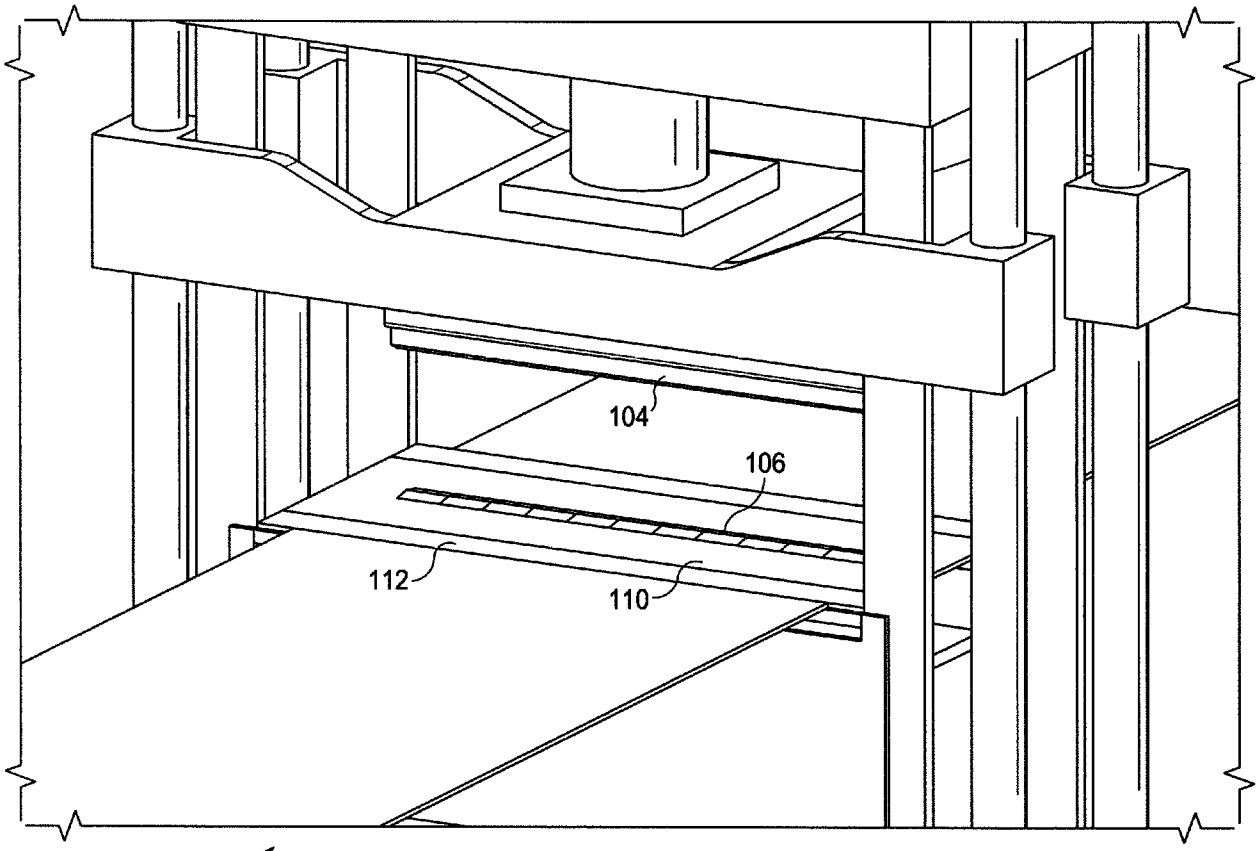
FIG. 1 is a diagram of a block splitting apparatus for creating a convex split face in accordance with an exemplary embodiment of the present disclosure.

In the description that follows, like parts are marked throughout the specification and drawings with the same reference numerals. The drawing figures might not be to scale and certain components can be shown in generalized or schematic form and identified by commercial designations in the interest of clarity and conciseness.

FIG. 1 is a diagram of a block splitting apparatus 100 for creating a convex split face in accordance with an exemplary embodiment of the present disclosure. Apparatus 100 can be used in conjunction with a block handling machine that places an assembly of whole concrete blocks on a conveyor, a conveyor system that moves the whole concrete blocks to a hydraulic press that has been fitted with block splitting blades, a conveyor assembly that moves the split blocks and other suitable equipment.

Apparatus 100 includes upper splitting blade 104 and lower splitting blade 106, which can each be formed from one or more of tungsten carbide, hardened AR steel or other suitable materials, and which can each have a smooth surface with no protrusions. Upper splitting blade 104 and lower splitting blade 106 can each have shallow shoulder angles and preferably have shoulder angles that are less than the friction angle. If the shoulder angle is less than the friction angle, then the splitting blade will hold the masonry block in position as it is being split, and will crush the edges of the masonry block to create a convex split face. Conversely, if the shoulder angle is greater than the friction angle, then the masonry block halves will, after the initial fracture, be squeezed away from the splitting blade with little or no split face convexity.

For most masonry materials, the friction angle is typically 15 to 20 degrees, but if the shoulder angle is less than about 5 degrees, then the debris from splitting operations can impede the subsequent process. In one exemplary embodiment, upper splitting blade 104 can be approximately 30 mm wide with a shoulder angle of approximately 10 degrees, and lower splitting blade 106 can be approximately 50 mm wide with a shoulder angle of approximately 10 degrees, although other widths and shoulder angles can also or alternatively be used.

Figure 2:
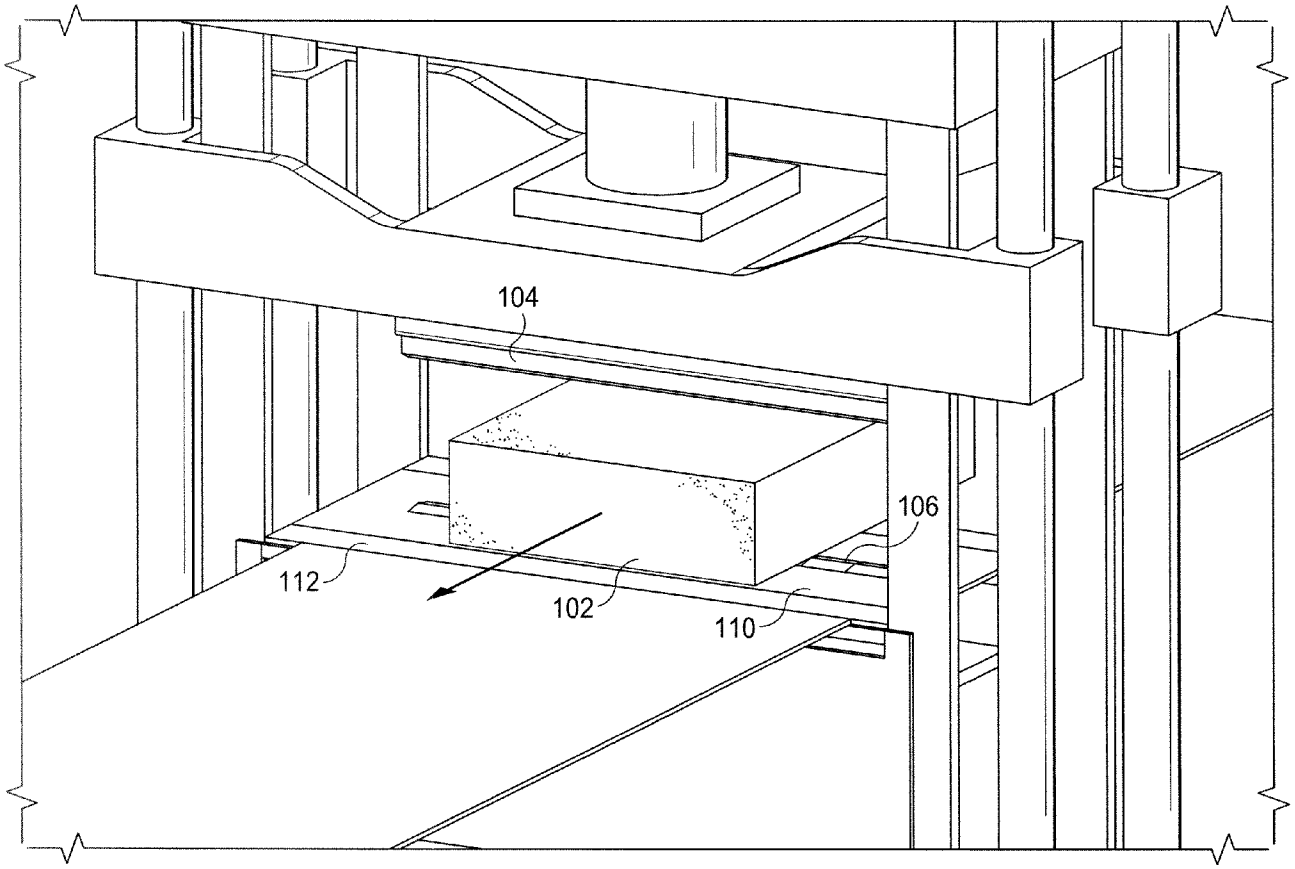
FIG. 2 is a diagram of a block splitting apparatus loaded with a masonry block, in accordance with an exemplary embodiment of the present disclosure.

FIG. 2 is a diagram of block splitting apparatus 100 loaded with masonry block 102, in accordance with an exemplary embodiment of the present disclosure. Block 102 is pushed into position by an adjacent block (not explicitly shown). The placement of block 102 can be controlled by an operator, by using optical or mechanical sensors, or in other suitable manners, in order to align splitting blades 104 and 106 with block 102 to a predetermined location. Although splitting blade 106 protrudes slightly from the top surfaces of blade holder 110, block 102 does not lean towards one side, because it is held in position by the adjacent blocks.

Figure 3:
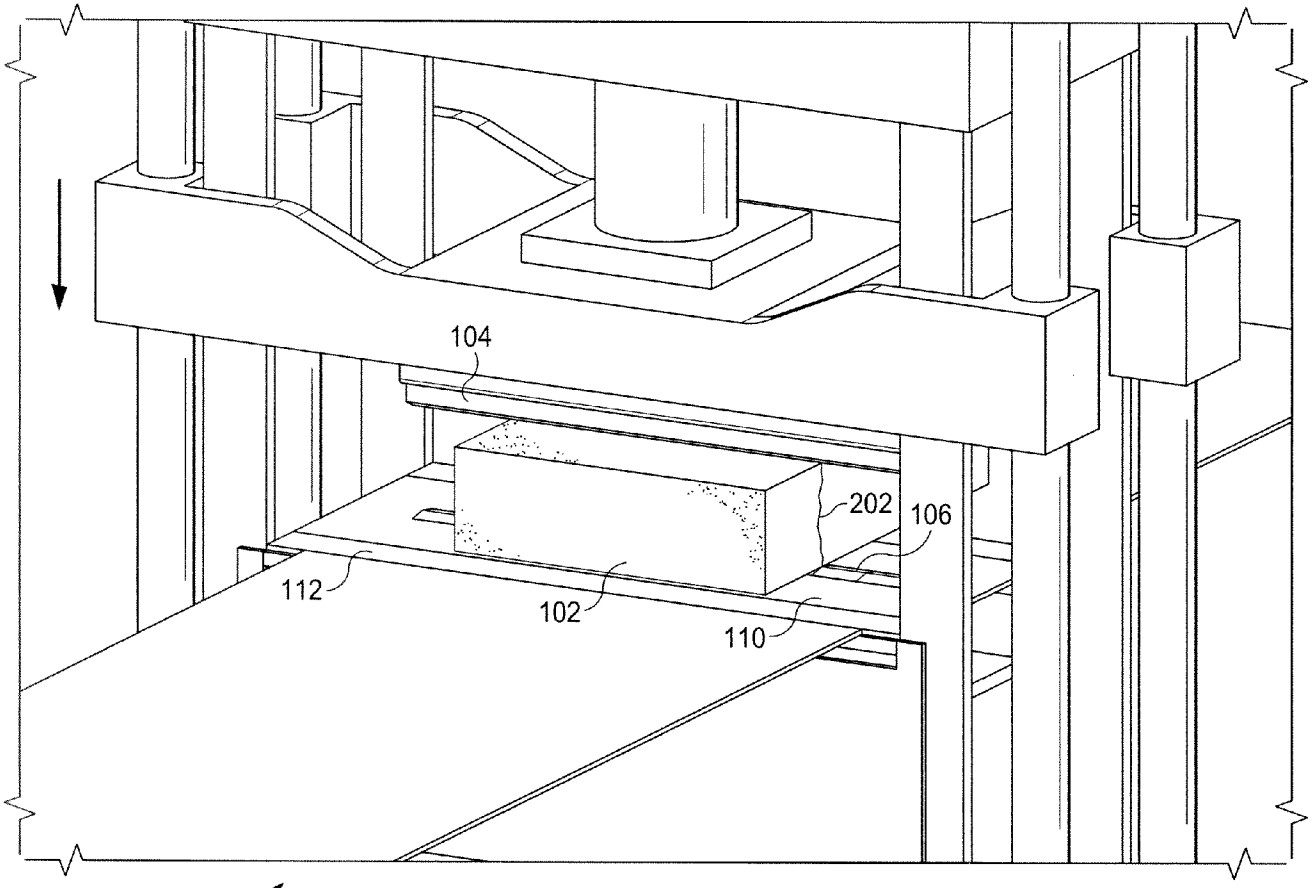
FIG. 3 is a diagram of a block splitting apparatus with a split in a masonry block, in accordance with an exemplary embodiment of the present disclosure.

FIG. 3 is a diagram of block splitting apparatus 100 loaded with a split 202 in masonry block 102, in accordance with an exemplary embodiment of the present disclosure. When block 102 is in position and upper splitting blade 104 is moved towards lower splitting blade 106, tension is induced in block 102 along the plane connecting the edges of splitting blades 104 and 106. A vertical fracture 202 then occurs in block 102, representing a tension-induced failure of block 102.

Figure 4:
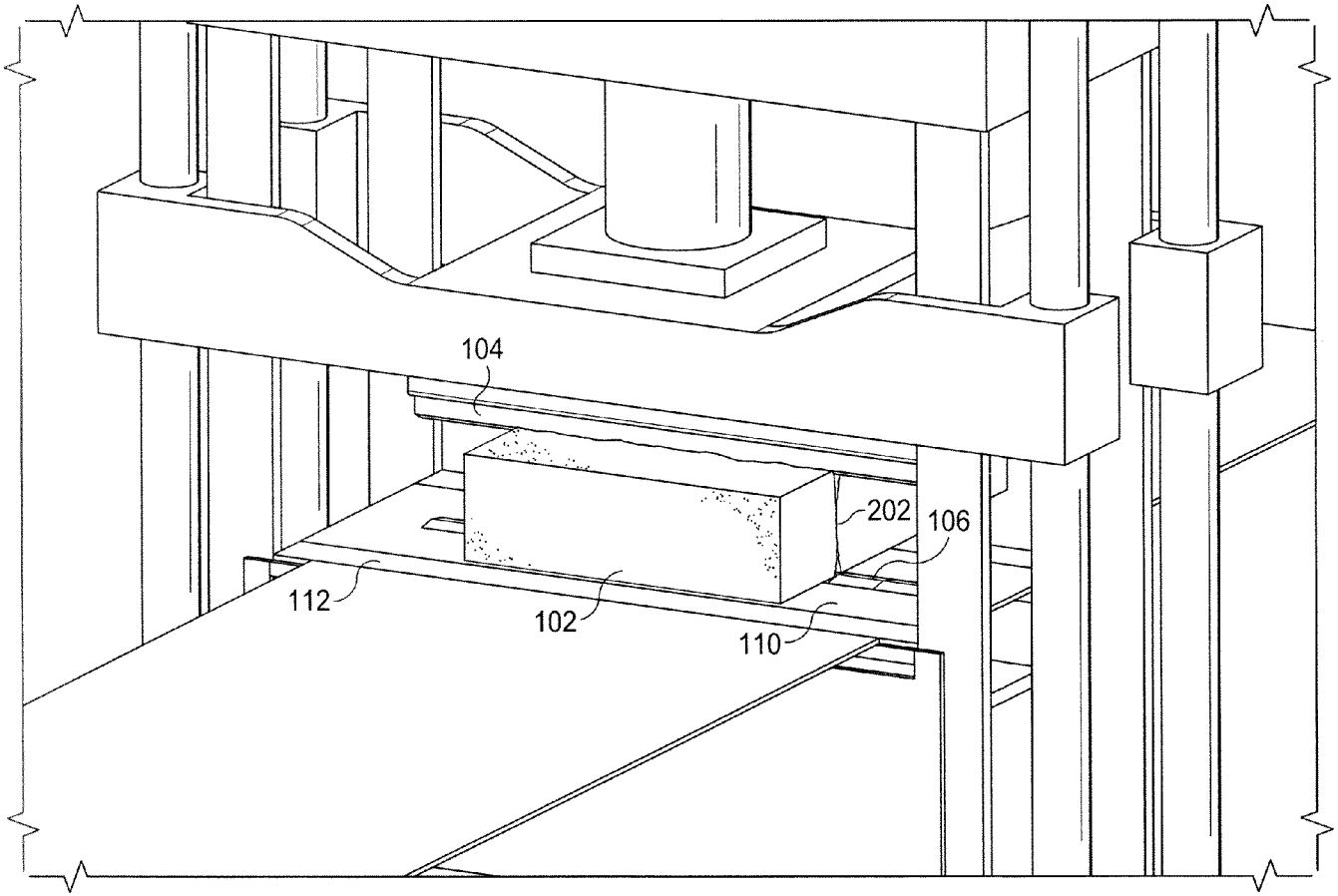
FIG. 4 is a diagram of a block splitting apparatus loaded with a split masonry block, in accordance with an exemplary embodiment of the present disclosure.

FIG. 4 is a diagram of block splitting apparatus 100 loaded with split masonry block 102, in accordance with an exemplary embodiment of the present disclosure. After vertical fracture 202 is formed in masonry block 102, the angled shoulder surfaces of splitting blades 104 and 106 then cause spalling of the block portions along the intersections of the split plane with the upper and lower surfaces of block 102 to form a convex split face. Although the angled shoulder surfaces of splitting blades 104 and 106 are smooth, the heterogeneous properties of the concrete create an irregular texture similar to that of the original vertical split.

Once the action of upper splitting blade 104 is completed, the split halves of the masonry block 102 are squeezed away from each other, which stops further spalling to the block portions along the intersections of the split plane with the upper and lower surfaces of block 102. In addition, some debris can be generated at that time, but the majority of the debris will be held in place by the split halves of masonry block 102.

Figure 5:
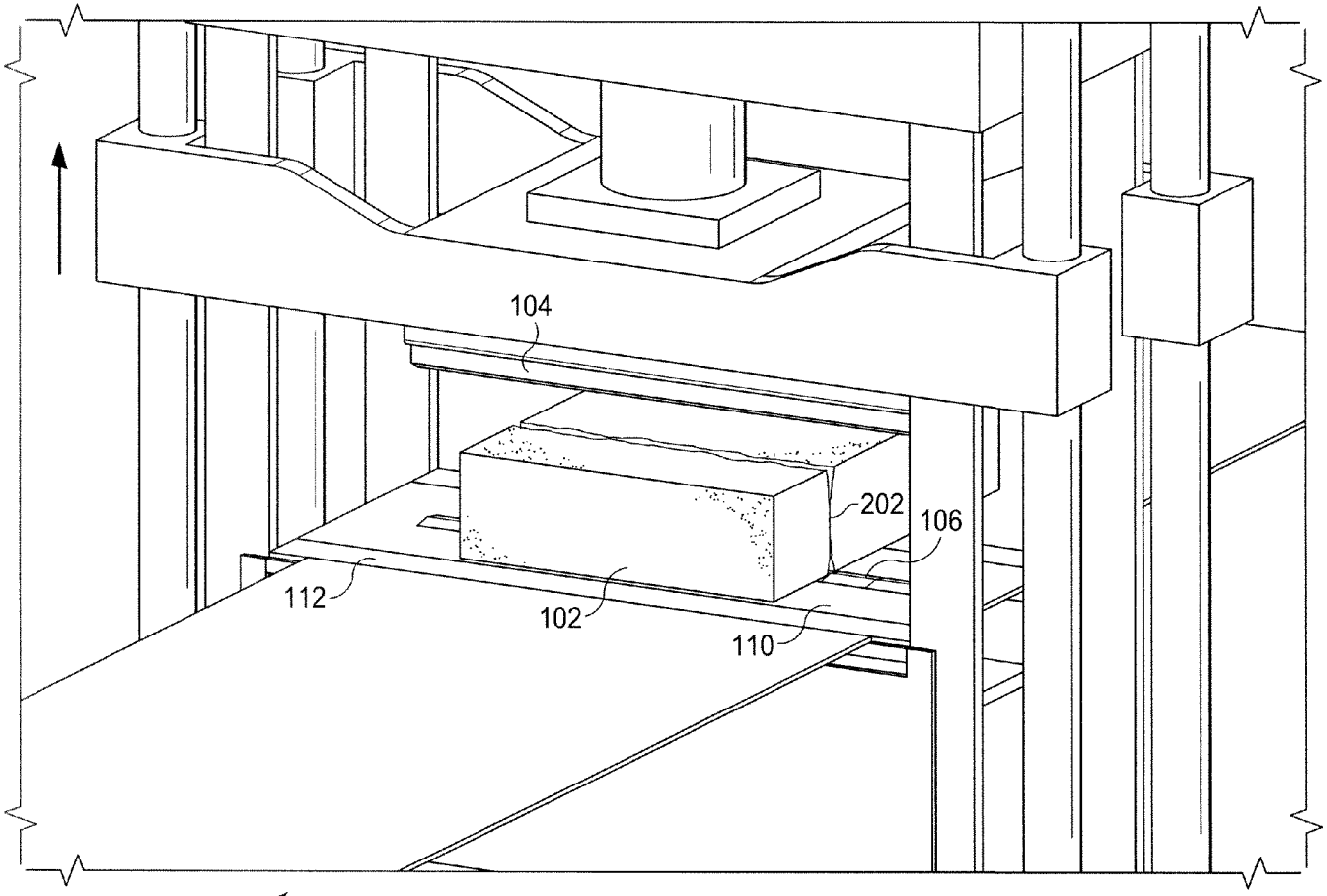
FIG. 5 is a diagram of a block splitting apparatus loaded with a split masonry block and retracted splitting blade, in accordance with an exemplary embodiment of the present disclosure.

FIG. 5 is a diagram of block splitting apparatus 100 loaded with a split masonry block 102 and retracted upper splitting blade 104, in accordance with an exemplary embodiment of the present disclosure. The debris formed by the splitting operation is not explicitly shown.

Figure 6:
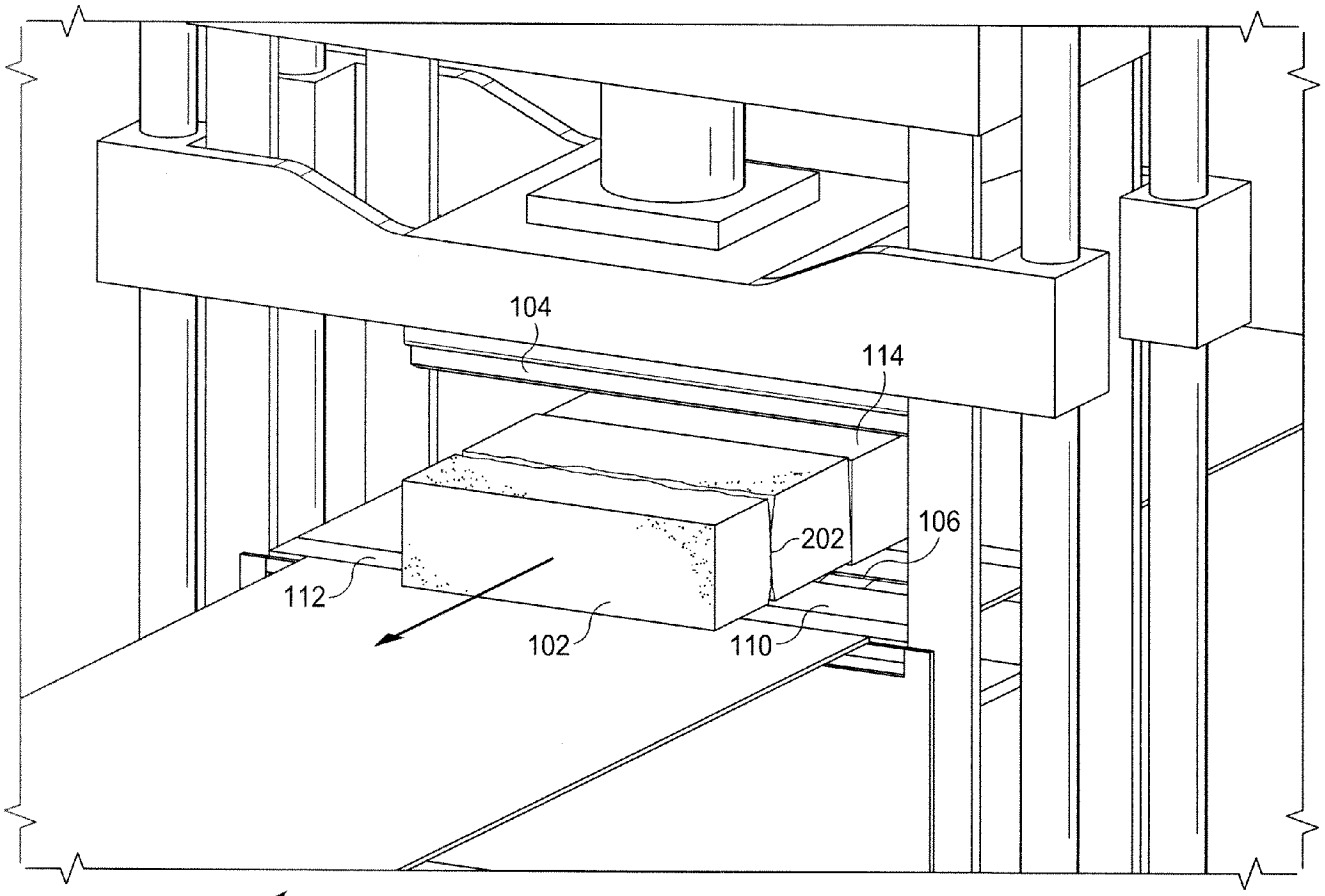
FIG. 6 is a diagram of a block splitting apparatus loaded with a masonry block, in accordance with an exemplary embodiment of the present disclosure.

FIG. 6 is a diagram of block splitting apparatus 100 loaded with masonry block 102, in accordance with an exemplary embodiment of the present disclosure. After the splitting operation is completed, the split pieces of block 102 are pushed towards outfeed plate 112, and a new block 102 is moved in behind the split block 102. As shown in FIG. 6, the front block 102 is elevated slightly relative to the rear block 102, as it rides over lower splitting blade 106. The sliding movement of the blocks cleans debris from the angled shoulder surfaces of lower splitting blade 106, as discussed in greater detail below. The surfaces of lower splitting blade 106 are smooth and easily cleaned by this sliding action, which preserves the geometry of the apparatus, without fouling or loading, for consistent results on subsequent splits.

Figure 7A:
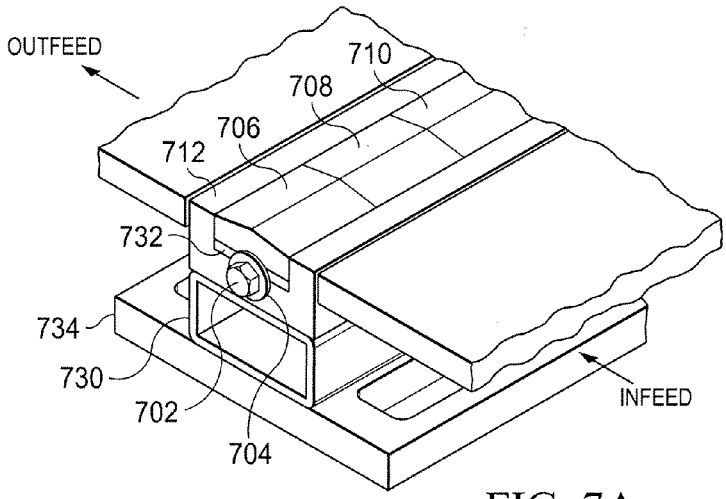
FIG. 7A is a diagram of a bottom splitting blade assembly, in accordance with an exemplary embodiment of the present disclosure.

FIG. 7A is a diagram of a bottom splitting blade assembly 700, in accordance with an exemplary embodiment of the present disclosure. Bottom splitting blade assembly 700 includes base plate 734, which blade support 730 is coupled to, such as with bolts or in other suitable manners. Blade holder 712 is coupled to blade support 730, such as with bolts or in other suitable manners, and includes a U-shaped channel that holds a plurality of blade segments 706, 708 and 710. Additional blade segments can also or alternatively be provided. In one exemplary embodiment, each blade segment is approximately 2" wide (W) by 2" long (L) by 0.5" high (H), although other suitable configurations can also or alternatively be used. A metal strip 732 formed from brass, aluminum or other soft metal or material, is used to accommodate variations in the dimensional tolerances of each of the blade segments and is also placed within the U-shaped channel.

The top of each blade segment includes a first flat surface and a second flat surface that meet at a point to form the blade edge. Each flat surface of the top of each blade segment extends downwards at an angle of approximately 10 degrees, although variations within approximately 5 to 15 degrees can also or alternately be used. At each side of the blade segment, the top surface interfaces with a side surface to form an edge, where the edge is typically configured to be flush with the top surfaces of blade holder 712. Each top surface of blade holder 712 is adjacent with a plate, such as an infeed plate and an outfeed plate, which are used to guide the masonry blocks into position onto bottom splitting blade assembly 700. The top surfaces of blade holder 712 are configured to bear the load of the masonry blocks during splitting, in order to reduce deflection and wear on the infeed and outfeed plates.

Figure 7B:
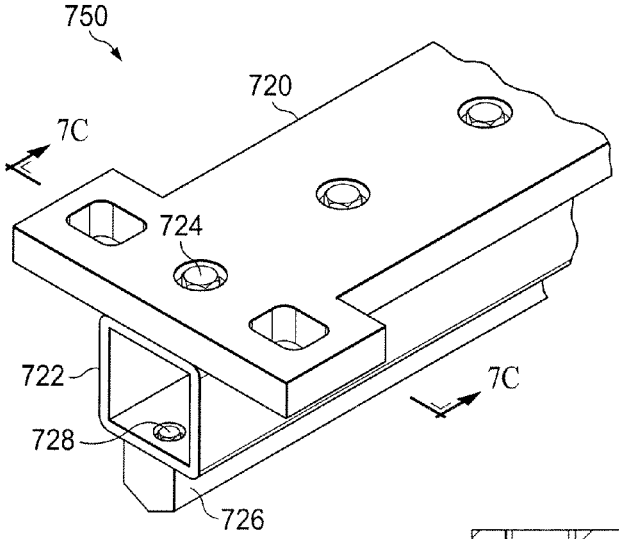
FIG. 7B is a diagram of a top splitting blade assembly, in accordance with an exemplary embodiment of the present disclosure.

FIG. 7B is a diagram of a top splitting blade assembly 750, in accordance with an exemplary embodiment of the present disclosure. Top splitting blade assembly 750 includes base plate 720, which blade support 722 is coupled to, such as with bolts 724 or in other suitable manners. Blade 726 is coupled to blade support 722, such as with bolts 728 or in other suitable manners. In one exemplary embodiment, blade 726 is approximately 30 mm wide by 1000 mm long by 15 mm high, although other suitable configurations can also or alternatively be used.

Figure 7C:
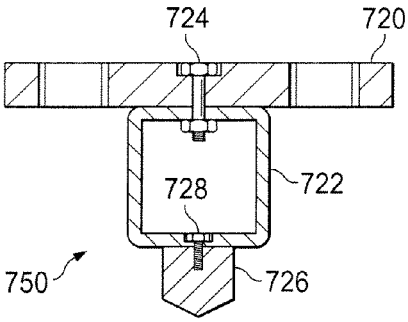
FIG. 7C is a side view of a top splitting blade assembly, in accordance with an exemplary embodiment of the present disclosure.

FIG. 7C is a side view of top splitting blade assembly 750, in accordance with an exemplary embodiment of the present disclosure.

Figure 7D:
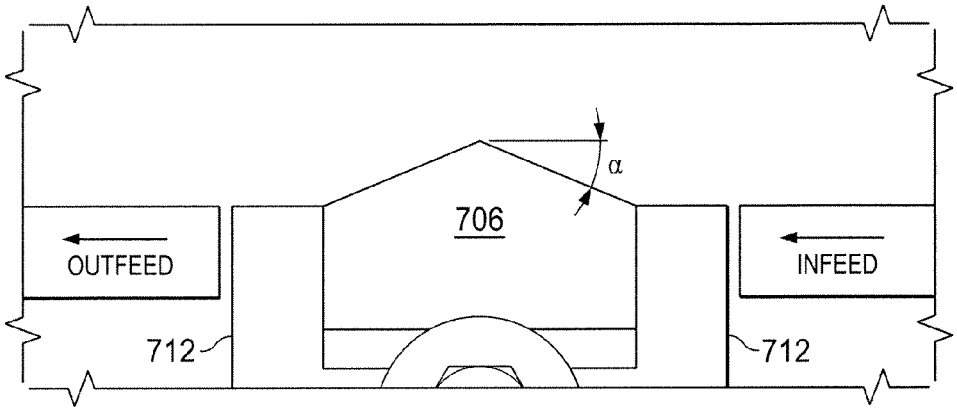
FIG. 7D is a detail view of a bottom splitting blade segment, showing shoulder angle $\alpha$ relative to the peak of a bottom splitting blade segment.

FIG. 7D is a detail view of a bottom splitting blade segment 706, showing shoulder angle $\alpha$ relative to the peak of bottom splitting blade segment 706. The blade portion of bottom splitting blade segment 706 is elevated above the top surfaces of blade holder 712, the infeed plate and the outfeed plate.

Figure 7E:
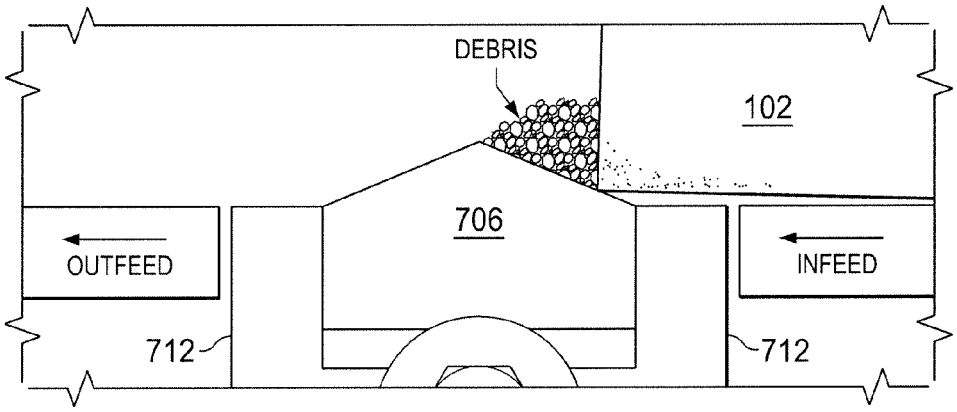
FIG. 7E is a detail view showing debris that has accumulated on the infeed edge surface of a bottom splitting blade segment, which is in the process of being wiped by the leading edge of a masonry block.

FIG. 7E is a detail view showing debris that has accumulated on the infeed edge surface of bottom splitting blade segment 706, which is in the process of being wiped by the leading edge of masonry block 102. As masonry block 102 is pushed forward by the conveyor, the edge of masonry block 102 is pushed up the smooth surface of the infeed edge of bottom splitting blade segment 706, which wipes the debris from the previous splitting operation away. Although this debris is pushed to the outfeed edge surface of bottom splitting blade segment 706, the amount of debris from a single splitting operation is relatively small, and is subsequently cleaned as discussed below.

Figure 7F:
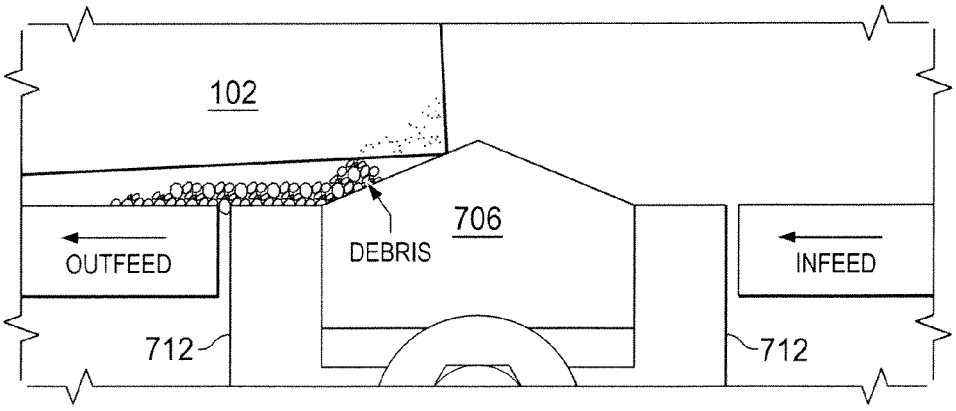
FIG. 7F is a detail view showing debris that has accumulated on the outfeed edge surface of a bottom splitting blade segment, which is in the process of being wiped by the trailing edge of a masonry block.

FIG. 7F is a detail view showing debris that has accumulated on the outfeed edge surface of bottom splitting blade segment 706, which is in the process of being wiped by the trailing edge of masonry block 102. As masonry block 102 is pushed forward by the next masonry block (not shown), the trailing edge of masonry block 102 is pushed down the smooth outfeed edge surface of bottom splitting blade segment 706, which wipes the debris from the previous splitting operation away.

Figure 8:
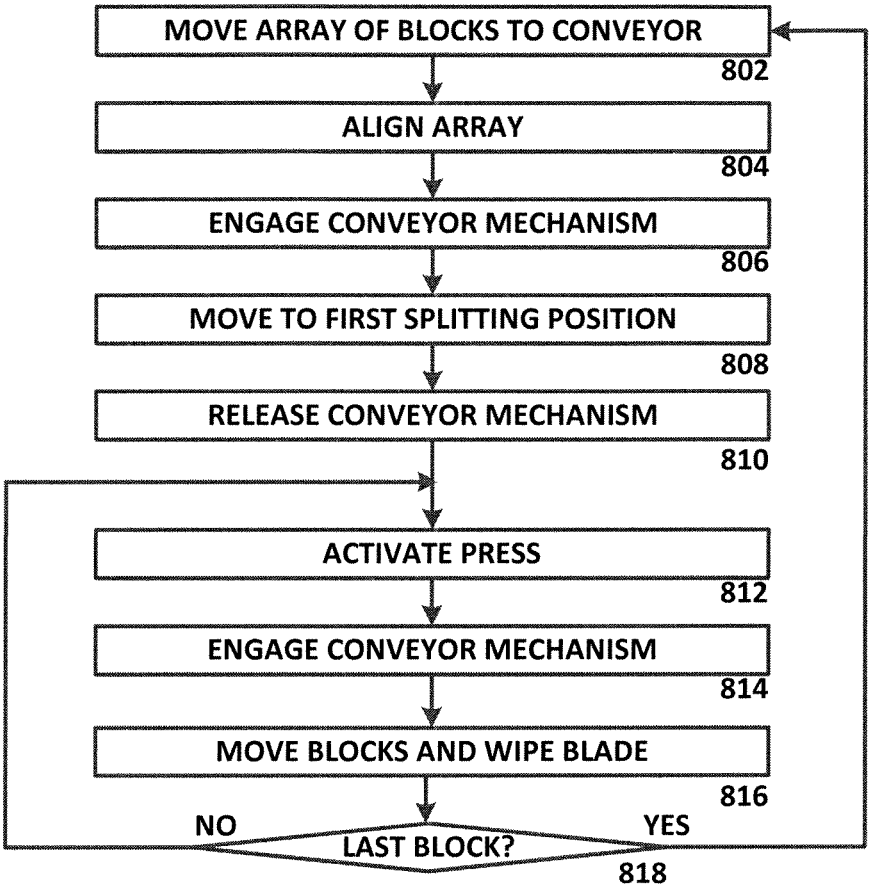
FIG. 8 is a flow chart of an algorithm for splitting masonry blocks, in accordance with an exemplary embodiment of the present disclosure.

FIG. 8 is a flow chart of an algorithm 800 for splitting masonry blocks, in accordance with an exemplary embodiment of the present disclosure. Algorithm 800 can be implemented in hardware, as one or more software systems operating on a programmable controller or in other suitable manners.

As used herein, "hardware" can include a combination of discrete components, an integrated circuit, an application-specific integrated circuit, a field programmable gate array, or other suitable hardware. As used herein, "software" can include one or more objects, agents, threads, lines of code, subroutines, separate software applications, two or more lines of code or other suitable software structures operating in two or more software applications, on one or more processors (where a processor includes a microcomputer or other suitable controller, memory devices, input-output devices, displays, data input devices such as a keyboard or a mouse, peripherals such as printers and speakers, associated drivers, control cards, power sources, network devices, docking station devices, or other suitable devices operating under control of software systems in conjunction with the processor or other devices), or other suitable software structures. In one exemplary embodiment, software can include one or more lines of code or other suitable software structures operating in a general purpose software application, such as an operating system, and one or more lines of code or other suitable software structures operating in a specific purpose software application. As used herein, the term "couple" and its cognate terms, such as "couples" and "coupled," can include a physical connection (such as a copper conductor), a virtual connection (such as through randomly assigned memory locations of a data memory device), a logical connection (such as through logical gates of a semiconducting device), other suitable connections, or a suitable combination of such connections.

Algorithm 800 begins at 802, where an array of blocks is moved to a conveyor. In one exemplary embodiment, blocks that are manufactured by a block manufacturing process can be stacked on pallets in a layered array, such as an 8×4 array, and a block handling machine can be used to move individual layers of the array to a conveyor system. The block handling machine can include a programmable controller, sensors, hydraulic calipers and other suitable devices that allow the top layer of the array of blocks to be located, to center the calipers on the array, to close the calipers with sufficient pressure to hold the array in place without crushing the individual masonry blocks, and to allow the array to be lifted by a crane and moved to a predetermined location without manual intervention, such as in response to one or more algorithm controls that are provided to the programmable controller (e.g. move calipers to pallet; align calipers; close calipers; raise calipers; move calipers to conveyor). The algorithm then proceeds to 804.

At 804, the array of blocks is aligned to the conveyor, such as by receiving one or more manual alignment commands, by using alignment sensors or in other suitable manners. The algorithm then proceeds to 806.

At 806, a conveyor mechanism is engaged to the rear side surface of the array. In one exemplary embodiment, the conveyor mechanism can include a plurality of motive elements that can be raised through the conveyor surface to engage the rear side surface of the array of blocks, and to apply a lateral force to move the array along the conveyor towards a splitting assembly. The conveyor mechanism can operate under control of a programmable controller in response to manual or sensor inputs, such as in response to one or more algorithm controls that are provided to the programmable controller (e.g. raise motive elements; move motive elements forward until resistance is measured; engage motive elements to force providing device). Likewise, other suitable conveyor mechanisms can also or alternatively be used. The algorithm then proceeds to 808.

At 808, the array of blocks is moved to a first splitting position. In one exemplary embodiment, the dimensions of the array can be used by the programmable controller to determine the first splitting position as a function of the location of the motive elements, sensors can be used to generate signals that are used by the programmable controller to confirm proper alignment of the array of blocks, manual alignment controls can be received at the programmable controller, or other suitable processes can also or alternatively be used. In another exemplary embodiment, the blocks can be textured instead of being split, where the top of the blade is aligned with an intersection between two block faces. The algorithm then proceeds to 810.

At 810, the conveyor mechanism is released, to prevent damage to the mechanism when splitting occurs. In this exemplary embodiment, when the first row of blocks in the array of blocks is split, the block halves will need to be able to move in either direction from the splitting tool when the angled surfaces of the upper blade are buried in the upper surface of the block. Releasing the conveyor mechanism allows this movement to occur during the splitting process without causing damage. The algorithm then proceeds to 812.

At 812, a hydraulic press or other suitable press is activated to split the masonry block and provide additional texturing, such as by using the splitting process discussed herein. In one exemplary embodiment, the programmable controller can receive an instruction to activate the press after sensor data confirming proper alignment has been received, or other suitable processes can also or alternatively be used. The algorithm then proceeds to 814.

At 814, the conveyor mechanism is engaged, such as by coupling the motive elements to a driver or other suitable systems or devices. The algorithm then proceeds to 816, where the blocks are moved to the next position and the bottom splitting blade is wiped by the movement of the blocks, such as by using a bottom splitting blade that is flush with the conveyor surface and that is not withdrawn between splitting operations. In one exemplary embodiment, the trailing edge of the split block can wipe the outfeed side of the splitting blade, and the leading of the next block to be split can wipe the infeed side of the splitting blade, as discussed herein. The programmable controller can receive an instruction to move the blocks by a predetermined distance or in other suitable manners. The algorithm then proceeds to 818.

At 818, it is determined whether the row of blocks that was split was a last row in an array. If it is determined that there are additional rows in the array to be split, the algorithm returns to 812, otherwise the algorithm returns to 802.

In operation, algorithm 800 allows masonry blocks to be split in a manner that reduces the amount of handling and which simplifies the operation of the splitting process. Algorithm 800 allows a splitting blade such as the one described herein to be used to split block, to provide a textured surface with minimal debris generation and minimal additional cleaning of the splitting blades.

Figure 9:
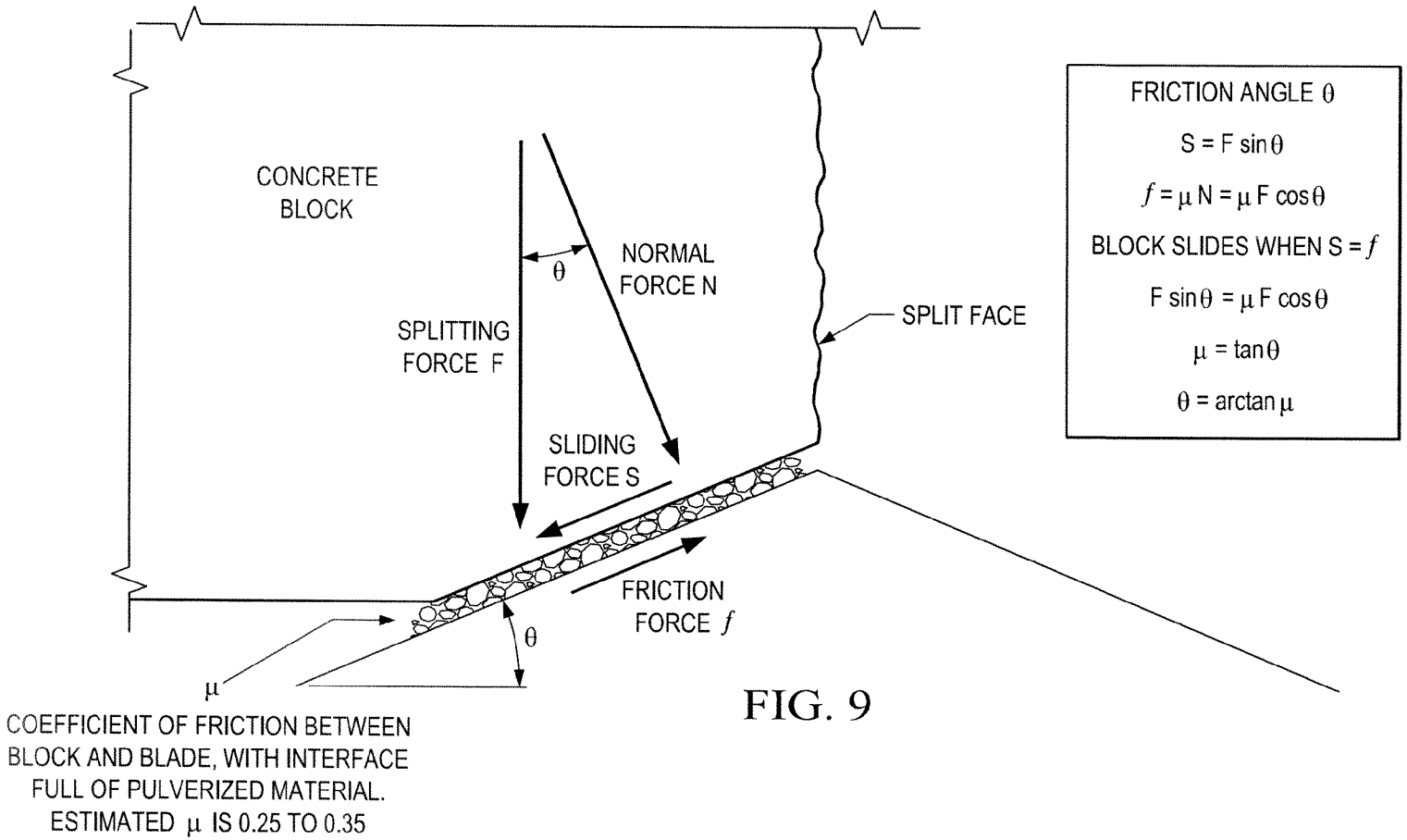
FIG. 9 is a force diagram in accordance with an exemplary embodiment of the present disclosure.

FIG. 9 is a force diagram in accordance with an exemplary embodiment of the present disclosure. As shown in FIG. 9, the splitting force F is comprised of a normal force $N=F*\cos\Theta$ and sliding force $S=F*\sin\Theta$. Friction force $f=\mu*N=\mu*F*\cos\Theta$ opposes sliding force S, and the concrete block slides when S is greater than f. In this exemplary embodiment, $\Theta=\arctan\mu$. Friction occurs between the block and the blade, where the interface is also filled with pulverized concrete block material. The estimate value for $\mu$ for such applications is 0.25 to 0.35.

Figure 10:
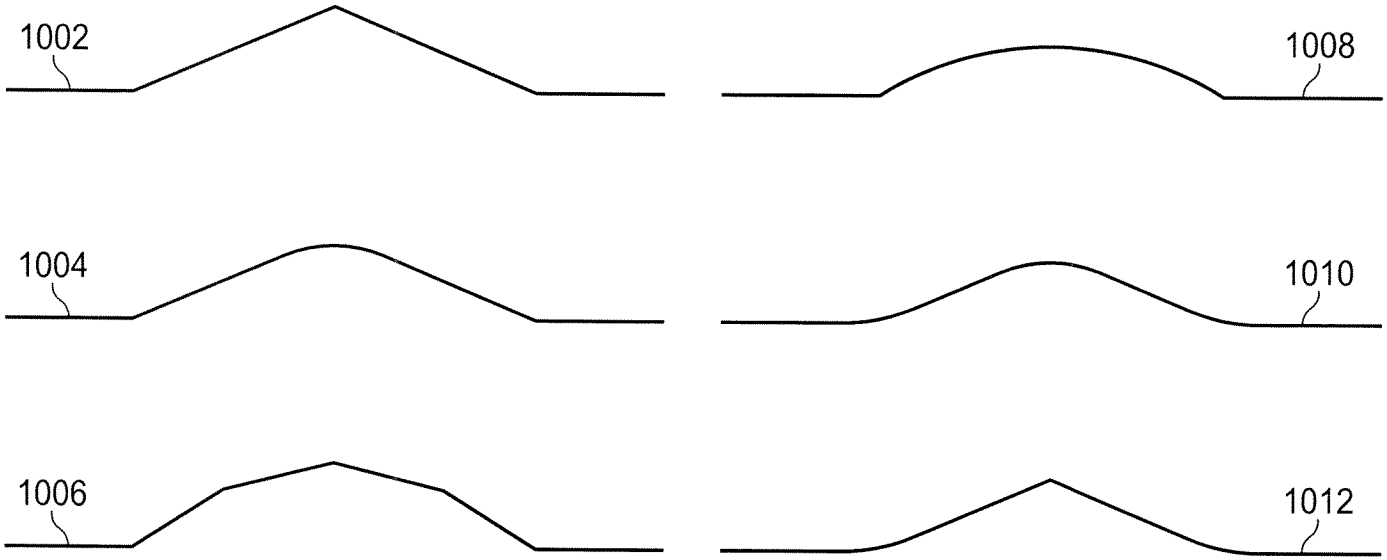
FIG. 10 is a diagram of splitting blade structures in accordance with an exemplary embodiment of the present disclosure.

FIG. 10 is a diagram of splitting blade structures 1002 through 1012 in accordance with an exemplary embodiment of the present disclosure. Splitting blade structure 1002 has the two-sided structure shown and discussed herein. Spitting blade structure 1004 has a rounded top instead of a point, but otherwise has two flat surfaces that lead up to the rounded top, like splitting blade structure 1002. Splitting blade structure 1006 has a series of flat surfaces at different angles, where the angles can be less than, equal to or greater than the friction angle, depending on the type of texturing desired. Splitting blade structure 1008 has a rounded profile, where the instantaneous slope of the blade at any point can be less than, equal to or greater than the friction angle, depending on the type of texturing desired. Splitting blade profile 1010 has a rounded base and top transition zone between the flat sides, and splitting blade profile 1012 has a rounded base and sharp top. The common characteristic of splitting blade profiles 1002 through 1012 is the ability of the splitting blades to be cleaned when held stationary in the path of the concrete blocks, because of the smooth surfaces and absence of any protrusions that prevent the splitting blades from being cleaned as the concrete blocks are moved over the splitting blade as the concrete blocks are being split.

Figure 11A:
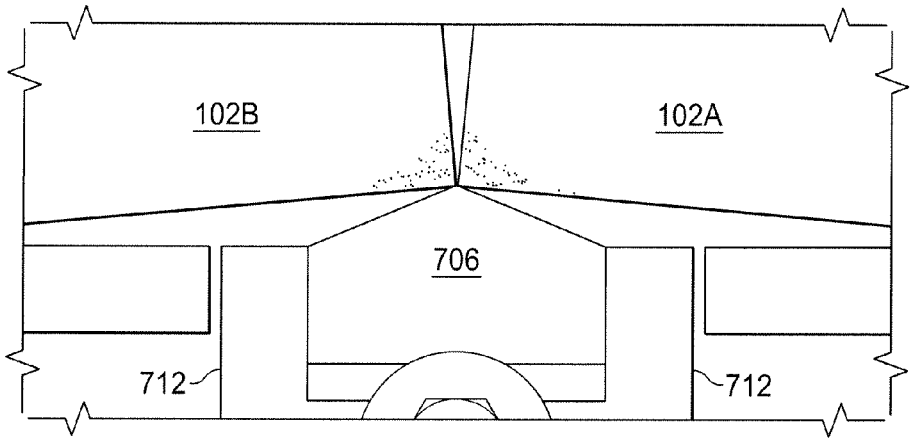
FIG. 11A is a diagram showing an edge texturing configuration prior to the application of pressure, in accordance with an exemplary embodiment of the present disclosure.

FIG. 11A is a diagram showing an edge texturing configuration prior to the application of pressure, in accordance with an exemplary embodiment of the present disclosure. In FIG. 11A, the blade segment 706 is oriented orthogonally to the usual splitting direction, such that the blade is parallel to the direction of travel of blocks 102A and 102B, which are adjacent to each other. As blocks 102A and 102B are pushed onto blade segment 706, they are aligned with the blade so as to be balanced at or near the top of the blade, with a space underneath.

Figure 11B:
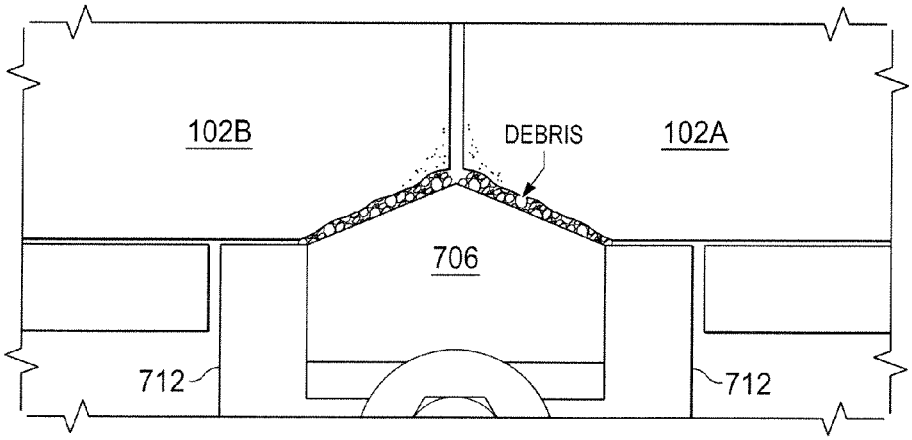
FIG. 11B is a diagram showing an edge texturing configuration after the application of pressure, in accordance with an exemplary embodiment of the present disclosure.

FIG. 11B is a diagram showing an edge texturing configuration after the application of pressure, in accordance with an exemplary embodiment of the present disclosure. As shown in FIG. 11B, blocks 102A and 102B have been pushed against blade segment 706 and have been crushed, where a layer of debris has formed between blade segment 706 and blocks 102A and 102B. In this manner, the edges of blocks 102A and 102B can be roughened or textured without the need to split blocks 102A and 102B. This roughening or texturing process is advantageous to processes that require the blocks to be tumbled mechanically, which is time consuming and which also results in significant amounts of breakage.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A splitting apparatus comprising:

a press configured to apply a force to a masonry block;

an assembly on which the masonry block rests;

a first splitting blade having a top with a width and a shoulder angle of less than 20 degrees and greater than 5 degrees, relative to a point in the middle of the top;

a blade support with a channel, wherein the first splitting blade is disposed within the channel; and a controller coupled to the press and a conveyor and configured to advance the masonry block over the first splitting blade to cause the masonry block to wipe debris from the splitting blade;

wherein the first splitting blade further comprises a first angled surface and a second angled surface, wherein at least one angled surface is smooth, that meet at the point in the middle of the top, the first angled surface intersects with a first side surface and the second angled surface intersects with a second side surface, and the intersection between the first angled surface and the first side surface is flush with a top surface of the blade support.

2. The splitting apparatus of claim 1 further comprising a second splitting blade disposed opposite the first splitting blade, the second splitting blade having a smooth top with a width and a shoulder angle of less than the friction angle, relative to a point in the middle of the top.

3. The splitting apparatus of claim 1 wherein the first splitting blade further comprises a plurality of segments.

4. The splitting apparatus of claim 1 wherein the first splitting blade further comprises a plurality of segments, each having a length and a width.

5. The splitting apparatus of claim 1 further comprising:

a metal strip disposed within the channel; and wherein the first splitting blade is disposed within the channel on top of the metal strip.

6. The splitting apparatus of claim 1 further comprising an infeed plate adjacent to the first splitting blade, with a predetermined gap between the infeed plate and the first splitting blade.

7. The splitting apparatus of claim 6 further comprising an outfeed plate adjacent to the first splitting blade, with a predetermined gap between the outfeed plate and the first splitting blade.

8. The splitting apparatus of claim 1, wherein the blade support comprises a first top surface disposed on a first side of the first splitting blade and a second top surface disposed on a second side of the first splitting blade.

9. The splitting apparatus of claim 1 further comprising:

a second splitting blade disposed opposite the first splitting blade, the second splitting blade having a smooth top with a width and a shoulder angle of less than the friction angle, relative to a point in the middle of the top; and a metal strip disposed within the channel;

wherein the first splitting blade is disposed within the channel on top of the metal strip.

10. The splitting apparatus of claim 1 further comprising:

a second splitting blade disposed opposite the first splitting blade, the second splitting blade having a smooth top with a width and a shoulder angle of less than the friction angle, relative to a point in the middle of the top; and an infeed plate adjacent to the first splitting blade, with a predetermined gap between the infeed plate and the first splitting blade.

11. The splitting apparatus of claim 1 further comprising:

a second splitting blade disposed opposite the first splitting blade, the second splitting blade having a smooth top with a width and a shoulder angle of less than the friction angle, relative to a point in the middle of the top; and an outfeed plate adjacent to the first splitting blade, with a predetermined gap between the outfeed plate and the first splitting blade.

12. The splitting apparatus of claim 1 further comprising a second splitting blade disposed opposite the first splitting blade, the second splitting blade having a smooth top with a width and a shoulder angle of less than the friction angle, relative to a point in the middle of the top, and wherein the blade support comprises a first top surface disposed on a first side of the first splitting blade and a second top surface disposed on a second side of the first splitting blade.

13. In a splitting apparatus having a first splitting blade having a smooth top with a width and a shoulder angle of less than 20 degrees and greater than 5 degrees, relative to a point in the middle of the top and a second splitting blade disposed opposite the first splitting blade, the second splitting blade having a smooth top with a width and a shoulder angle of less than the friction angle of the masonry block to be split, relative to a point in the middle of the top, a blade support with a channel, wherein the first splitting blade is disposed within the channel, wherein the first splitting blade further comprises a plurality of segments, each having a length and a width, a blade support with a channel, a metal strip disposed within the channel, wherein the first splitting blade is disposed within the channel on top of the metal strip, an infeed plate adjacent to the first splitting blade, with a predetermined gap between the infeed plate and the first splitting blade, an outfeed plate adjacent to the first splitting blade, with a predetermined gap between the outfeed plate and the first splitting blade, wherein the blade support comprises a first shoulder disposed on a first side of the first splitting blade and a second shoulder disposed on a second side of the first splitting blade, wherein the first splitting blade further comprises a first top surface and a second top surface that meet at the point in the middle of the top, wherein the first top surface intersects with a first side surface and the second top surface intersects with a second side surface, and wherein the intersection between the first top surface and the first side is flush with a first shoulder of the blade support, a method of splitting masonry blocks, comprising:

actuating a lifting mechanism to lift an array of masonry blocks from a pallet;

transferring the array of masonry blocks to a conveyor device;

engaging a motive element of the conveyor device;

moving the array of masonry blocks along the conveyor device to a splitting mechanism;

pushing a first row of masonry blocks over the first splitting blade that extends into a plane of the conveyor;

releasing the motive element after the first row of masonry blocks is centered on the first splitting blade;

splitting the first row masonry blocks;

pressing a surface of a masonry block against a smooth surface that has an incline of less than a friction angle of the concrete block until debris is generated;

cleaning the smooth surface of the debris by pushing the masonry block over the surface;

re-engaging the motive element;

wiping an outfeed edge of the first splitting blade with a rear corner of the first row of masonry blocks;

wiping an infeed edge of the first splitting blade with a front corner of a second rock of masonry blocks, wherein splitting the first row of masonry blocks comprises moving the second splitting blade towards the first splitting blade while holding the bottom splitting blade stationary;

crushing an edge of a masonry block against a smooth surface having an incline of less than a friction angle until debris is generated;

wiping the debris from the smooth surface by sliding the masonry block over the surface;

wherein a hydraulic press produces the crushing action, a powered conveyor produces the sliding action, the crushing action and sliding action are approximately orthogonal, the smooth surface comprises pulverized concrete, the smooth surface further comprises one or more features for retaining pulverized concrete from the debris;

pushing a first masonry block towards a block-engaging blade surface;

sliding the first masonry block over the block-engaging blade surface having shoulder angles less than the friction angle;

removing debris from the block engaging blade surface by repeating the pushing and sliding steps;

positioning the masonry block between an upstream block and a downstream block;

moving the masonry block onto a fixed, raised blade edge; and aligning the masonry block for splitting with the upstream block and the downstream block.

14. A splitting apparatus comprising:

a press configured to apply a force to a masonry block;

an assembly on which the masonry block rests;

a first splitting blade having a top with a width and a shoulder angle of less than 20 degrees and greater than 5 degrees, relative to a point in the middle of the top, wherein the first splitting blade further comprises a plurality of segments;

a second splitting blade disposed opposite the first splitting blade, the second splitting blade having a smooth top with a width and a shoulder angle of less than the friction angle, relative to a point in the middle of the top;

a blade support with a channel, wherein the first splitting blade is disposed within the channel; and a controller coupled to the press and a conveyor and configured to advance the masonry block over the first splitting blade to cause the masonry block to wipe debris from the splitting blade;

wherein the first splitting blade further comprises a first angled surface and a second angled surface, wherein at least one angled surface is smooth, that meet at the point in the middle of the top, the first angled surface intersects with a first side surface and the second angled surface intersects with a second side surface, and the intersection between the first angled surface and the first side surface is flush with a top surface of the blade support.

15. The splitting apparatus of claim 14 wherein the first splitting blade further comprises a plurality of segments, each having a length and a width.

16. The splitting apparatus of claim 14 further comprising:

a metal strip disposed within the channel; and wherein the first splitting blade is disposed within the channel on top of the metal strip.

17. The splitting apparatus of claim 14 further comprising an infeed plate adjacent to the first splitting blade, with a predetermined gap between the infeed plate and the first splitting blade.

18. The splitting apparatus of claim 17 further comprising an outfeed plate adjacent to the first splitting blade, with a predetermined gap between the outfeed plate and the first splitting blade.

19. The splitting apparatus of claim 14, wherein the blade support comprises a first top surface disposed on a first side of the first splitting blade and a second top surface disposed on a second side of the first splitting blade.

20. The splitting apparatus of claim 14 further comprising a second splitting blade disposed opposite the first splitting blade, the second splitting blade having a smooth top with a width and a shoulder angle of less than the friction angle, relative to a point in the middle of the top, wherein the first splitting blade further comprises a plurality of segments, each having a length and a width.

* * * * *